US008613573B2

(12) United States Patent
Kadiu

(10) Patent No.: US 8,613,573 B2
(45) Date of Patent: Dec. 24, 2013

(54) TELESCOPIC SHORING SYSTEM

(76) Inventor: Max Kadiu, Cupertino, CA (US)

( * ) Notice: Subject to any disclaimer, the term of this patent is extended or adjusted under 35 U.S.C. 154(b) by 0 days.

(21) Appl. No.: 12/584,548

(22) Filed: Sep. 8, 2009

(65) Prior Publication Data

US 2011/0058903 A1 Mar. 10, 2011

(51) Int. Cl.
*E02D 5/00* (2006.01)

(52) U.S. Cl.
USPC ..... 405/282; 405/272

(58) Field of Classification Search
USPC ..... 405/272, 273, 282, 283, 288, 294; 256/65.04
See application file for complete search history.

(56) References Cited

U.S. PATENT DOCUMENTS

| | | | | | |
|---|---|---|---|---|---|
| 1,246,135 | A * | 11/1917 | Meem | 405/272 |
| 3,530,679 | A | 9/1970 | Krings | 405/282 |
| 3,621,660 | A | 11/1971 | Krings | 405/282 |
| 3,910,053 | A | 10/1975 | Krings | 405/282 |
| 4,657,442 | A | 4/1987 | Krings | 405/282 |
| 5,310,289 | A | 5/1994 | Hess et al. | 405/282 |
| 5,503,504 | A | 4/1996 | Hess et al. | 405/282 |
| 5,902,075 | A | 5/1999 | Krings | 405/282 |
| 5,931,607 | A | 8/1999 | Hess | 405/282 |
| 6,076,694 | A * | 6/2000 | Ragot | 220/23.83 |
| 6,155,750 | A | 12/2000 | Wu et al. | 405/282 |
| 6,164,874 | A | 12/2000 | May | 405/283 |
| 6,224,296 | B1 | 5/2001 | Fukumori | 405/282 |
| 6,474,911 | B1 | 11/2002 | Krings | 405/282 |
| 2004/0156686 | A1 * | 8/2004 | Kadiu | 405/272 |
| 2004/0170478 | A1 * | 9/2004 | Kadiu | 405/282 |

* cited by examiner

*Primary Examiner* — Benjamin Fiorello

(57) ABSTRACT

A telescopic shoring system for shoring open excavations comprises rail posts composed by at least an outer member and an inner member, and large shoring panels. Each outer and inner member of the rail post has laterally, on either side, at least one panel guide allowing the shoring panels to slide within. The outer member of the rail post has a frontal guide adapted to interlock the back guide provided to the inner member but sliding relatively to each other. The shoring panels are arranged on each side of the excavation while the rail posts are placed on each corner holding on either side the shoring panels, which create a multi-stepped shoring box. The outer members of the rail post with shoring panels create an outer or upper shoring box while the inner members of the rail post in combination with shoring panels create an inner or lower shoring box.

9 Claims, 9 Drawing Sheets

TELESCOPIC SHORING SYSTEM

CROSS-REFERENCE TO RELATED APPLICATIONS

Technical Field

This invention relates to apparatuses for shoring open excavations.

BACKGROUND OF THE INVENTION

This invention relates to shoring systems used to support the walls of open excavations. The shoring system comprises large shoring panels and rail posts. The rail post consists of at least two members, an outer member and an inner member. Both members of the rail post have laterally, on either side, panel guides allowing shoring panels to slide vertically within. In addition, the outer member has lengthwise a frontal guide interlocking the back guide provided to the inner member so that each member slides relatively to the other. The shoring panels have laterally, at either end, a guide edge to slide vertically within panel guide of the rail post. For deep excavation, the rail post may have one or more intermediate members sliding between the outer member and the inner member. Similarly to the outer member and the inner member of the rail post, the intermediate member has laterally, on either side, a panel guide and is provided with a front guide and a back guide to interlock respectively with the inner member and the outer member of the rail post.

There are many devices used to shore the walls of open excavations. Such shoring devices are commonly called trench or manhole shields. The trench shields have usually two panels held by individual spreaders pinned or bolted onto the extremities of each panel via flanges or fixed connectors. The manhole shields have four panels forming together a solid box. These devices are rigid in a sense that they do not allow relative movement between spreaders and panels and are usually installed after excavation is completed.

Another type of shoring device, which is commonly called slide rail shoring system, uses rail posts spreader systems and large shoring panels. The shoring system has a plurality of pairs of opposite rail posts spaced along the trench in the way that each pair is supported by a spreader frame, which slides in between the rail posts. Each rail support is provided on either side with guide channels where edges of large shoring panels slide within so that every two adjacent rails are connected with at least one shoring panel. This type of shoring device is currently used in the construction projects and depending on each specific design provides a wide range of conflicting or arguable results.

U.S. Pat. Nos. 3,910,053 and 4,657,442 (Krings), U.S. Pat. Nos. 5,310,289 and 5,503,504 (Hess et al.), U.S. Pat. No. 6,164,874 (May) disclose various slide rail shoring systems, all of them including multiple pairs of columns, spreader systems and large shoring panels. The support columns, or as well called as the rail posts, are made in one piece for the entire depth of the excavation or shoring wall. As result, various issues must be overcome when using current slide rail shoring systems. First of all, when assembling the shoring system the rail posts are vertically away up in the air, often conflicting with overhead obstacles such as electric lines, trees and can not be installed in highway underpasses, under bridges or overpasses, inside building, etc. In addition, the shoring panel accesses the guide of the rail post from the upper end rendering the installation very difficult, often time consuming and dangerous for the workers. Also, when pushing the rail posts or the entire shoring system down as excavation deepens, the upper or previously installed shoring panels are in permanent friction with the rail posts increasing drastically the resistive forces. As result, the rail posts often rotate or lean out of aplomb binding the entire shoring system. When this happen, the entire shoring system has to be to removed and reinstalled. Other issues such as the weight of rail posts, their damages and especially the difficulties during the removal have limited the use and increased the cost of slide rail shoring system. Yet another critical issue, is the limited depth of excavation due to above mentioned reasons as well as the fact that many panels must be staked what creates insurmountable difficulties during removal of the shoring system. The slide rail shoring system is a dig and push system by mean that is installed simultaneously to the excavation only, never afterward. Or, in hard soils, it becomes very difficult to push down each component of these shoring systems and it's necessary to dig underneath the rail posts and shoring panels what is not always possible or accessible.

Other knowing shoring device that has panels sliding vertically within excavation without using vertical support columns is disclosed in U.S. Pat. No. 6,224,296 (Fukumori). This device uses two pairs of large shoring panels. The first pair of panels, which shores the upper part of trench pressing against the excavation walls, is fixed at ground level. The second pair of panels slides within first pair shoring thereby the lower part of excavation. Both pairs of panels are connected and use sets of rigging to control the installation and removal of this device. Such device performs poorly in deep excavation and requires accurate installation regarding the space between first pair of panels their parallelism, etc. The removal of the panel is also associated with damages of guiding pair of panels.

BRIEF SUMMARY OF THE INVENTION

This shoring system comprises large shoring panels and rail posts. Each shoring panel has laterally, on either end, a guide edge. Each rail post is composed of at least two members, an outer member and an inner member. The outer member of the rail post has lengthwise a frontal guide interlocking the back guide provided to the inner member of the rail post. Thus, the inner member of the rail post slides vertically relative to the outer member. Lengthwise, each outer member and each inner member have laterally, on either side, at least one panel guide encompassing the edge guide of the shoring panel. Thus, shoring panels slide vertically relative to the outer and the inner member of the rail post. In this aspect, each member, outer or inner, represents on itself a rail post. In very deep excavations, the rail post may comprise one or more intermediate members sliding between the outer member and the inner member of the rail post. Like the outer and inner members of the rail post, each intermediate member has laterally, on either side, at least one panel guide. In addition, the intermediate member of the rail post has a back guide and a front guide matching respectively the front guide of outer member and the back guide of inner member.

For simplicity, the following description of the shoring system is provided for excavations having in plan view a rectangular shaped section. However, as shown subsequently, the shoring system applies in excavations having in plan view a polygonal shaped section of three, four, five, six or more corners.

The shoring panels are arranged on each side of the excavation while the rail post are placed on each corner holding on either side shoring panels and forming all together a multi-stepped shoring box. The outer members of the rail posts in combination with respective shoring panels create an outer or an upper shoring box while the inner members and their respective shoring panels create an inner or lower shoring box.

The length of the outer member of the rail post is comparable to the height of the outer shoring box, which strongly facilitate the assembling procedure during the installation of the shoring system. The inner member of the rail post could be as long as the depth of excavation or comparable to it. However, the optimal length for the inner member of the rail posts is somewhere comparable to the height of the inner box.

Normally, the outer members of the rail posts and their respective shoring panels are assembled together during first stage of excavation, up to 4 ft. deep or even more, depending on stability of the ground surrounding the excavation. There is not a strict order in assembling the component of the shoring system, i.e., either an outer member of the rail post or a shoring panel can be installed at first. Once a component is installed, the other component slides relatively to the installed component. Thus, each panel slides vertically within the installed outer member of the rail post and vice versa. When the shoring panels and the outer members are installed, an outer or upper shoring box is formed. Afterward, as the excavation progresses, the shoring panels and the outer members of the rail post are pushed down evenly to excavation.

When the top of the shoring panel is almost even to ground level then the inner members of the rail posts are installed. Each inner member of the rail post slides within frontal guide of the outer member. Afterward, the shoring panels are inserted and slide vertically between the guides of adjacent inner members creating an inner or a lower shoring box. After completing the inner box and as excavation progresses, only the components of the inner box are pushed down evenly to excavation. When intermediate members of the rail post are used in combination with shoring panels, then an intermediate shoring boxes is formed.

Normally, the operator while digging uses the bucket or the boom of the excavator to push down each component of the shoring system. However, special tools such as a long anvil or a pressing column could be used to push the inner member of the rail post or the shoring panels. Nevertheless, these special tools are neither relevant to the invention nor part of it.

Substantially, the intent of present invention is to provide a telescopic shoring system of type described above comprising rail posts having at least an outer member and an inner member sliding relatively to each other while provided with panel guides to allow for shoring panels to slide vertically within.

Pursuing this objective and others that will be explicit subsequently, the important aspect of the present invention is to design a telescopic shoring system wherein the lower or inner components slide relatively to the outer or upper components.

The very important aspect of this shoring system is the invention of a rail post having two or more members sliding relatively to each other, which simplifies the installation and removal of the shoring system. On one hand, the length and the weight of the rail post is reduced rendering it user friendly; on the other hand, the resistive forces and the friction applied on the lower and the upper components of the shoring system are fully separated. Furthermore, the removal of the shoring system, which starts with the inner box, could be initiated (optionally) by removing the inner members of the rail posts first, which releases the shoring panels of the inner box.

Another important aspect of this shoring system is its use in applications having overhead obstacles, or in highway underpasses, under bridges or overpasses, inside building, etc.

Yet another important factor of this invention is its modular aspect and the capacity to shore any polygonal shaped excavation of three, four, five or more sides. In addition, in hard soils, when the upper shoring box is installed and its friction with soil is attained, the excavation could be achieved as far down as the required depth while the component of the inner or lower shoring box may be installed afterward.

The new features considered as characteristic for the invention are set forth in the appended claims. Other advantages of the invention will be appreciated in view of the following description and drawings.

DETAILED DESCRIPTION OF THE INVENTION

Figure 1:
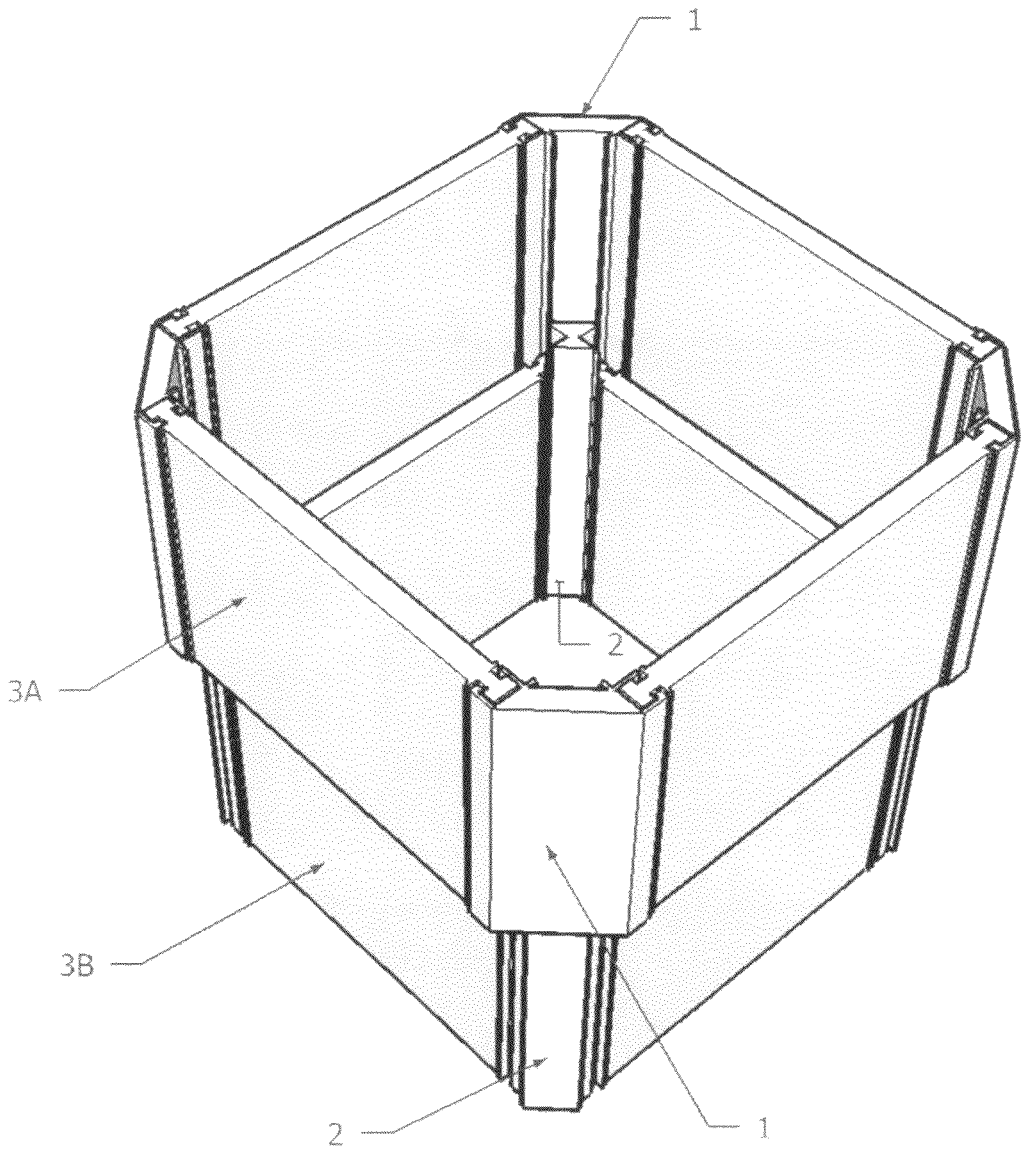
FIG. 1 is a three dimensional view of the shoring system showing the outer member and the inner member of the rail posts and the shoring panels in a four sided excavation.
Figure 2:
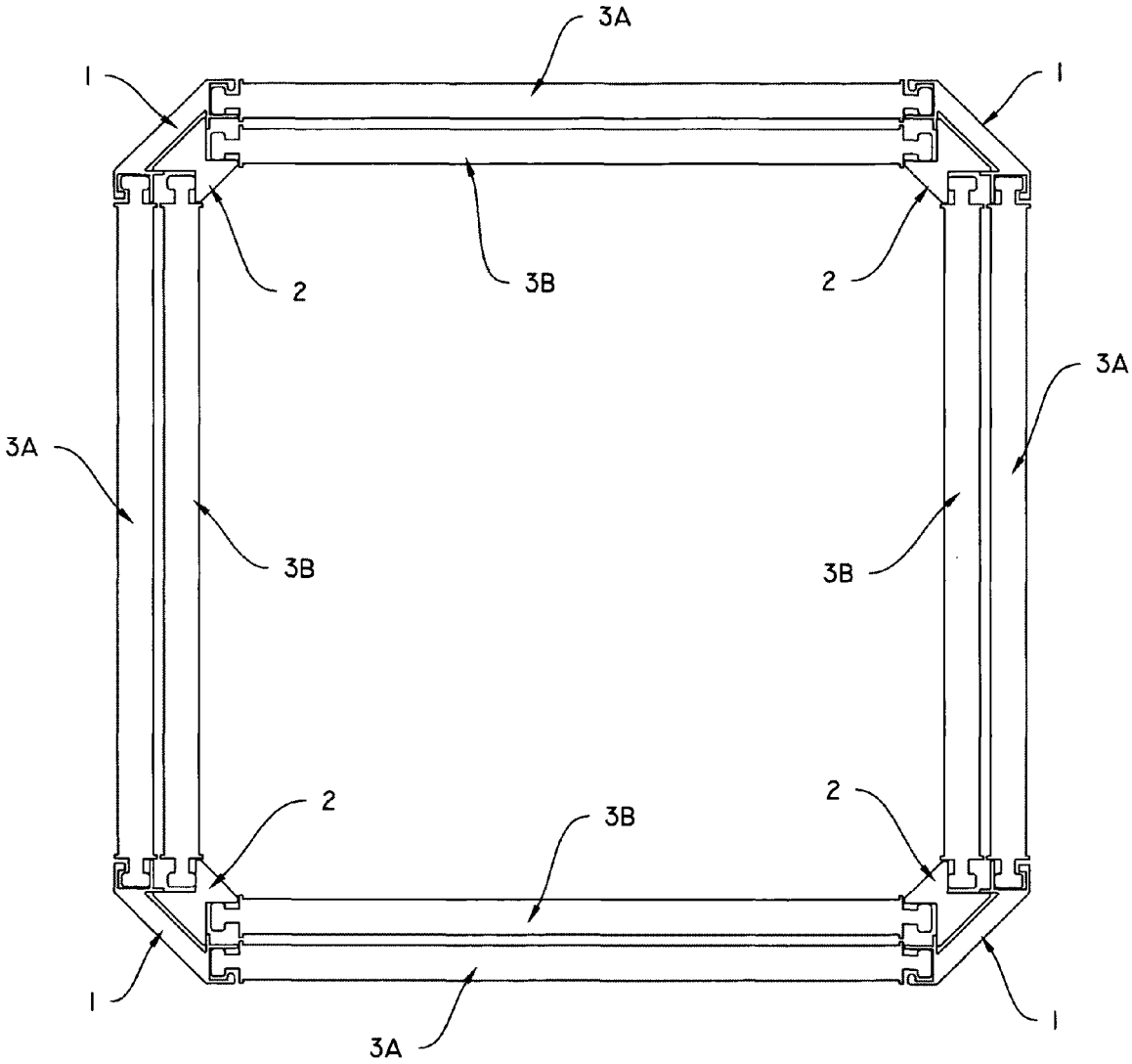
FIG. 2 is a top view of the FIG. 1, showing the cross section of the outer member and the inner member of the rail post, and the shoring panels.

Referring to the drawings where like numerals indicate like elements, various embodiments incorporating the new features of the present invention are illustrated. FIG. 1 and FIG. 2 illustrate the outer member 1 and the inner member 2 of the rail post arranged on each corner of a rectangular excavation.

Figure 3:
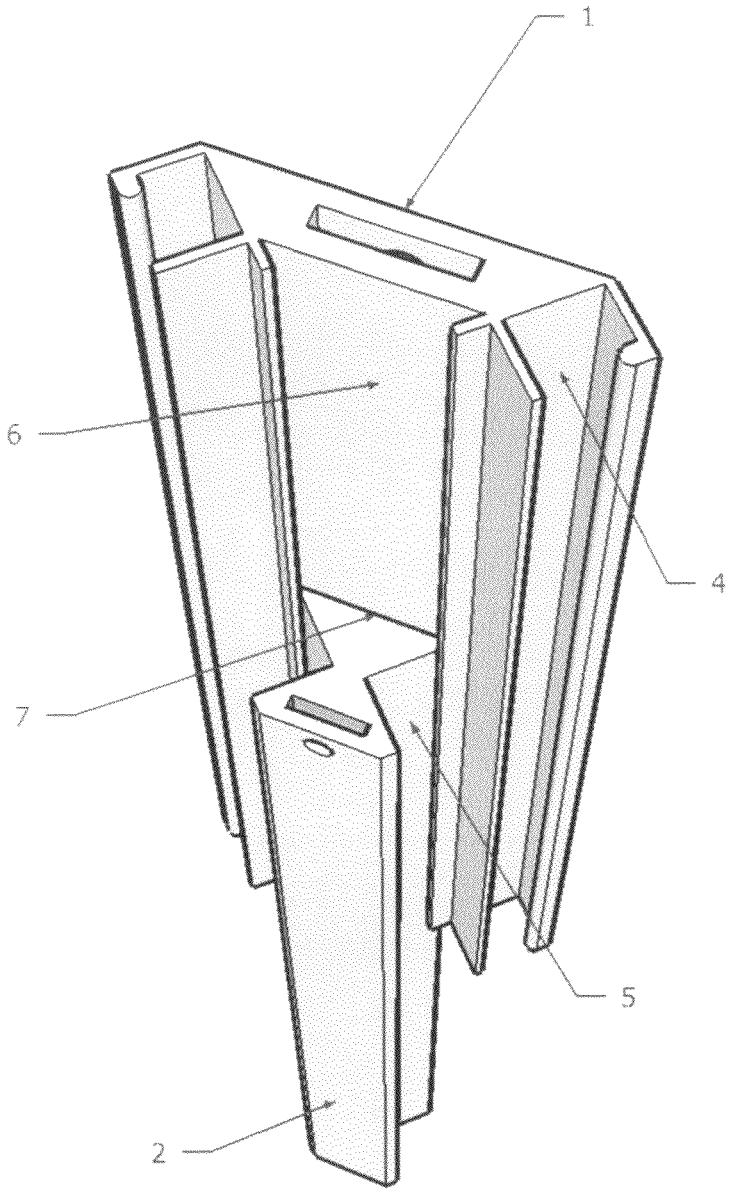
FIG. 3 is a three dimensional view of a rail post showing the outer member and the inner member.

The outer members 1 and the shoring panels 3A shape an outer or upper shoring box. The inner member 2 and the shoring panels 3B shape an inner or lower shoring box. As shown in the FIG. 3, the outer member 1 and the inner member 2 of the rail post have laterally, on either side, the panel guides 4 and 5 respectively. In addition, the outer member 1 has a frontal guide 6 wherein slides vertically the "triangularly shaped" back guide 7 of the inner member 2 of the rail post.

Figure 4:
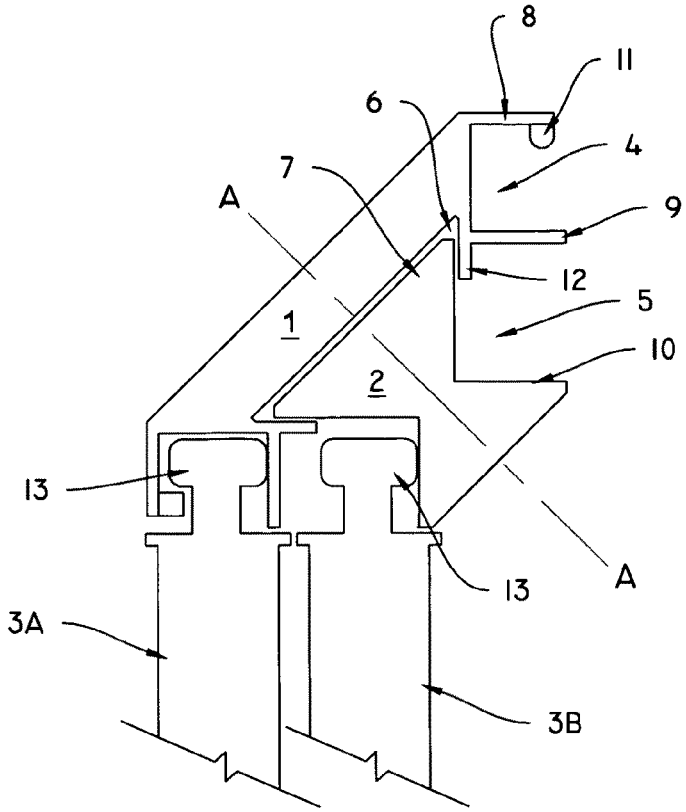
FIG. 4 is a sectional view of the rail post illustrating the interlocking guides of inner member and outer member and the panel guides.
Figure 5:
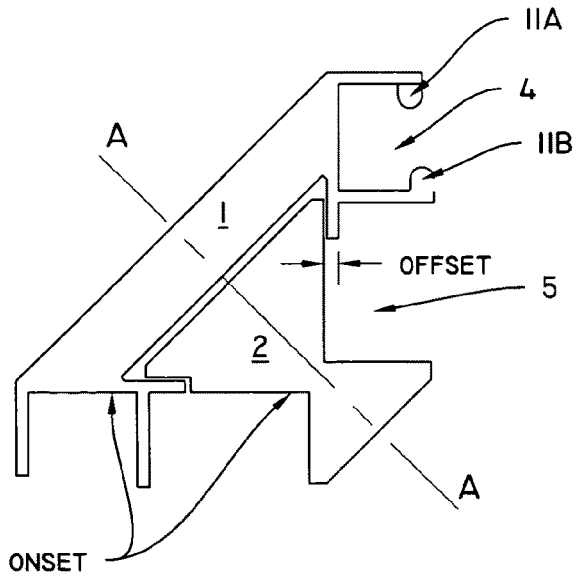
FIG. 5 is yet another top or sectional view of the rail post illustrating the interlocking guides of outer member and inner member, the panel guides as well as their alignments.
Figure 6:
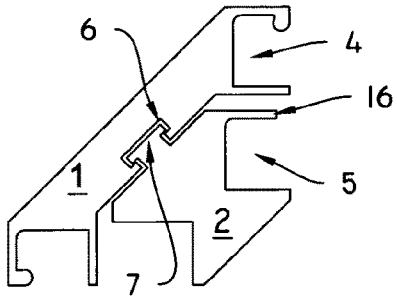
FIG. 6 is a sectional view of a rail post showing another interlocking type between the outer member and the inner member of the rail post.
Figure 7:
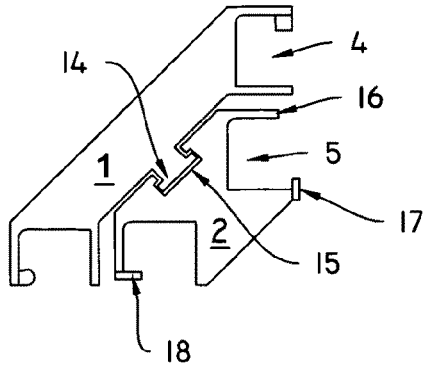
FIG. 7 is a sectional view showing the interlocking between the outer member and the inner member of the rail post, which is reverse to the one shown in FIG. 6.
Figure 8:
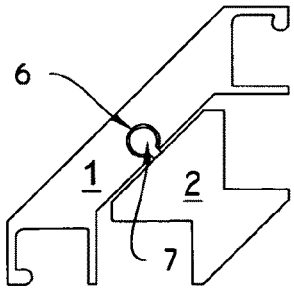
FIG. 8 is a sectional view showing a round shaped type of interlocking between the outer member and the inner member of the rail post.
Figure 9:
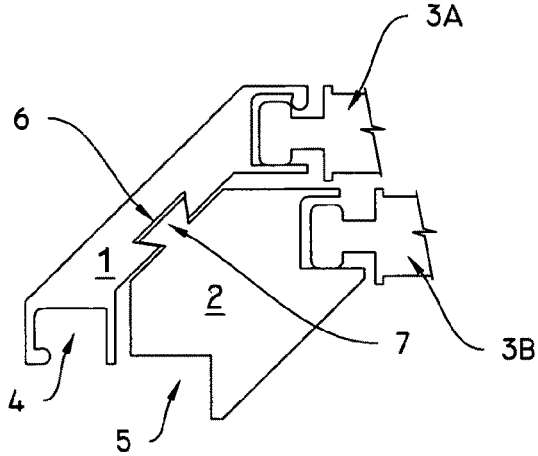
FIG. 9 is a top or sectional view of the rail post showing yet another type of interlocking between outer member and the inner member of the rail post and the panel guides being aligned largely offset.

In the FIG. 4 and thereafter, the line A-A stands for the symmetrical axes. The outer member 1 of the rail post has laterally on either side the supporting flange 9 and the back flange 8 forming altogether the panel guide 4 wherein slides the shoring panel 3A. In the preferred embodiment, the panel guide 4 is adapted to interlock the shoring panel 3A by way of locking bar 11 provided on the back flange 8 in combination with guide edge 13 of shoring panel 3A. However, the embodiment where the panel guide is not adapted to interlock the shoring panel is obviously simple and obtained by just removing the locking bar 11, as shown in FIG. 5 on one side of the outer member 1. In this case, an accessory device, which evidently is not a part of the shoring system and not shown, could be used to temporary hold two adjacent shoring panels while sliding the outer member of the rail post simultaneously on both shoring panels. Afterward, the accessory device is removed while the outer member holds both shoring panels. As shown in FIG. 4, the locking bar 11 may have a circular or rectangular cross section. Frontally, the outer member 1 has on either side a guide flange 12 forming the frontal guide 6 wherein slides vertically the "triangularly shaped" back guide 7 of the inner member 2 of the rail post. In this embodiment, the back guide 7 is identified by the back part of the inner member 2 itself, whose cross section is triangularly shaped to interlock but slide within the frontal guide 6 of the outer member 1. The inner member 2 of the rail post has laterally, on either side, a supporting flange 10 to shape the panel guide 5 where slides the shoring panel 3B by way of guide edge 13. As shown in the FIG. 5, by design, the panel guide 5 of the inner member 2 may by aligned offset or onset relative to panel guide 4 of the outer member 1. The interlocking between outer member 1 and inner member 2 may be carried out in various ways. FIG. 6 shows a frontal guide 6 of a 'C' type interlocking the back guide 7 of 'T' type. The FIG. 7 shows the reverse interlocking of the one shown in FIG. 6, wherein a 'T' type guide 14 of the outer member 1 interlock within a 'C' type guide 15 of the inner member 2. The reversing role in the interlocking of the outer member 1 and the inner member 2 does not change the substance of the invention, which resides on the fact that the inner member 2 slides relative to the outer member 1. Although the type and role of each component in the interlocking of the outer member 1 and inner member 2 does not represent a limit for the invention, few other types of interlocking are illustrated subsequently. FIG. 8 and FIG. 9 show interlocking features similar to the 'C' and 'T' types, which have slight nuances in shapes such as round or trapezoidal. In addition, it is shown that panel guide 5 of the inner member 2 may be optionally provided with a back flange 16. The panel guide 5 may be even adapted to interlock the guide edge 13 of the panel 3 using locking bars 17 and/or 18 fixed respectively on supporting flange 10 or the back flange 16. Also, the panel guide 5 may be aligned largely offset relating to panel guide 4, what actually imposes the panel 3B of the lower shoring box to be shorter in length than the shoring panel 3A of the upper shoring box.

Figure 10:
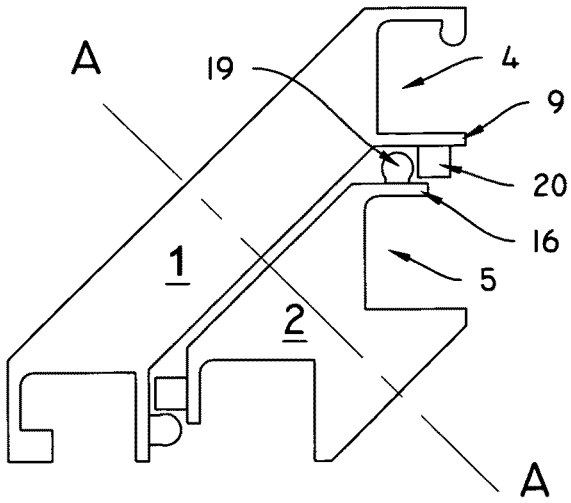
FIG. 10 is a top or sectional view of the rail post showing yet another type of interlocking between outer member and the inner member of the rail post.

FIG. 10 shows yet another form of interlocking of the outer member 1 and inner member 2 using the locking bar 20 fixed on the supporting flange 9 of the panel guide 4 and the locking bar 19 placed on the back flange of the panel guide 5. Either locking bar 19 and 20 may have a cross section of circular, rectangular or other shapes.

Figure 11:
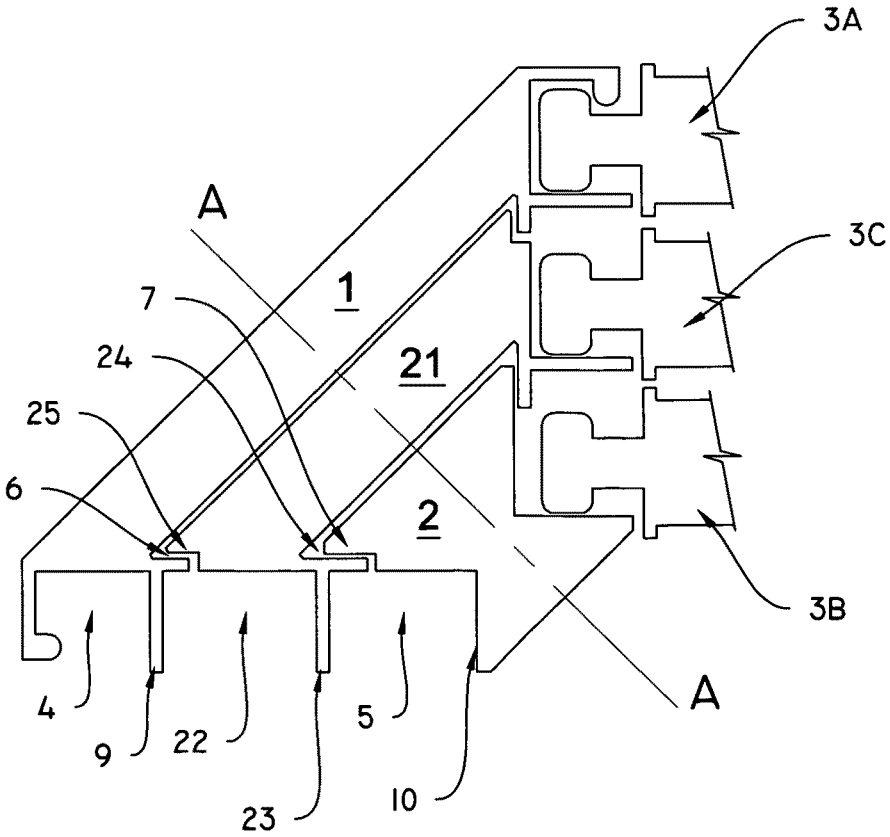
FIG. 11 is a sectional view of a rail post having an outer member, an inner member and an intermediate member.

FIG. 11 illustrates a rail post having the outer member 1, the inner member 2 and an intermediate member 21. The intermediate member 21 has laterally, on either side, the panel guide 22 wherein slides the shoring panel 3C to shape an intermediate shoring box (not shown). Also, the intermediate member 21 has a front guide 24 interlocking the back guide 7 of the inner member 2, and a back guide 25 to interlock within the front guide 6 of the outer member 1.

Figure 12:
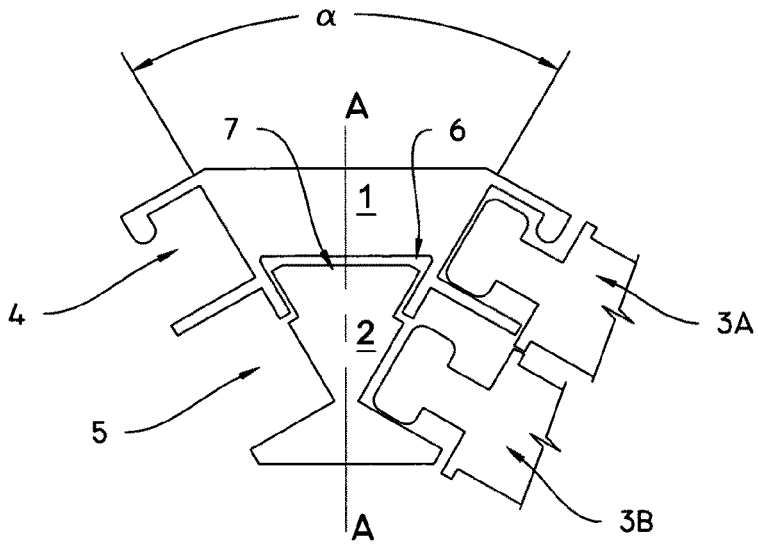
FIG. 12 is a sectional view of the rail post showing an outer member and an inner member whose lateral opposing sides create an angle $\alpha$ inferior than 90 degrees.
Figure 13:
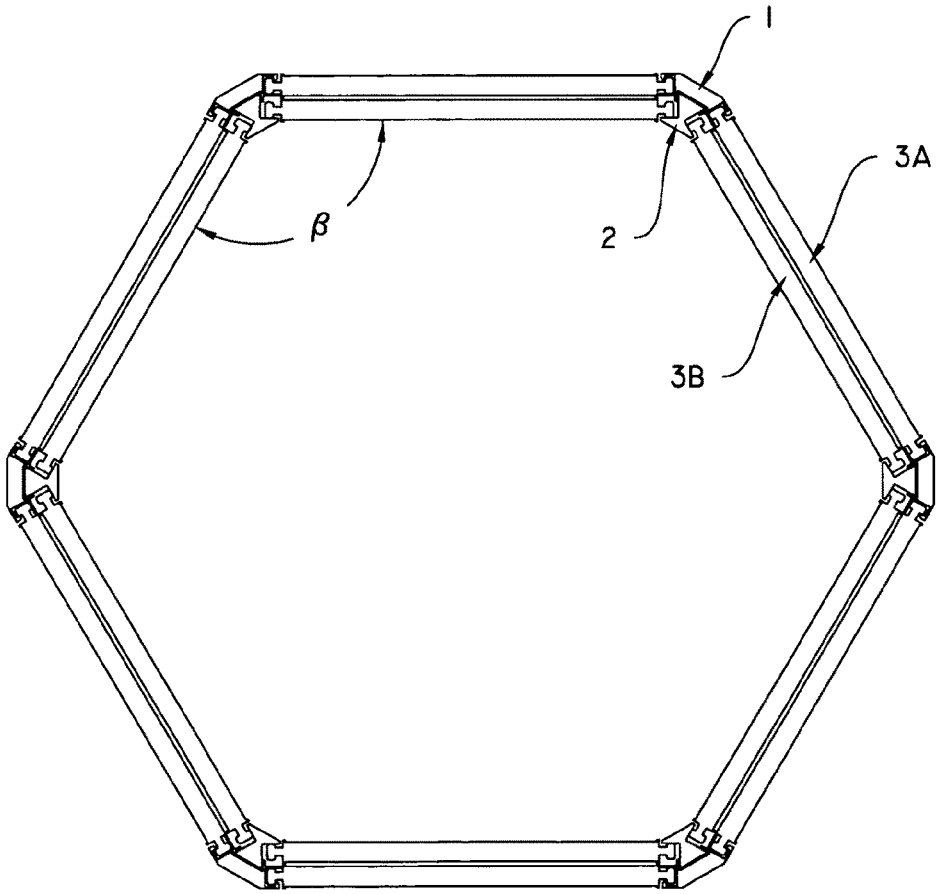
FIG. 13 is a top view of a hexagonal shaped excavation using a hexagonal telescoping shoring system.

As shown in the FIG. 12, lateral opposing sides of the outer member 1 and of the inner member 2 create an angle $\alpha$, whose value may vary from zero to 90 degrees or more depending on the number of sides of the shoring. As an example, for a three sided excavation or shoring box, the angle $\alpha$=120 degree. The FIG. 13 shows a hexagonal shoring box. The adjacent sides of the shoring box create an angle $\beta$. The value of the angle $\beta$ correlates to value of the angle $\alpha$ by the equation: $\alpha=180-\beta$. Thus, for a rectangular shoring box: $\alpha=\beta=90$ degrees and for a hexagonal shoring box, $\alpha=60$ and $\beta=120$ degrees, etc.

Figure 14:
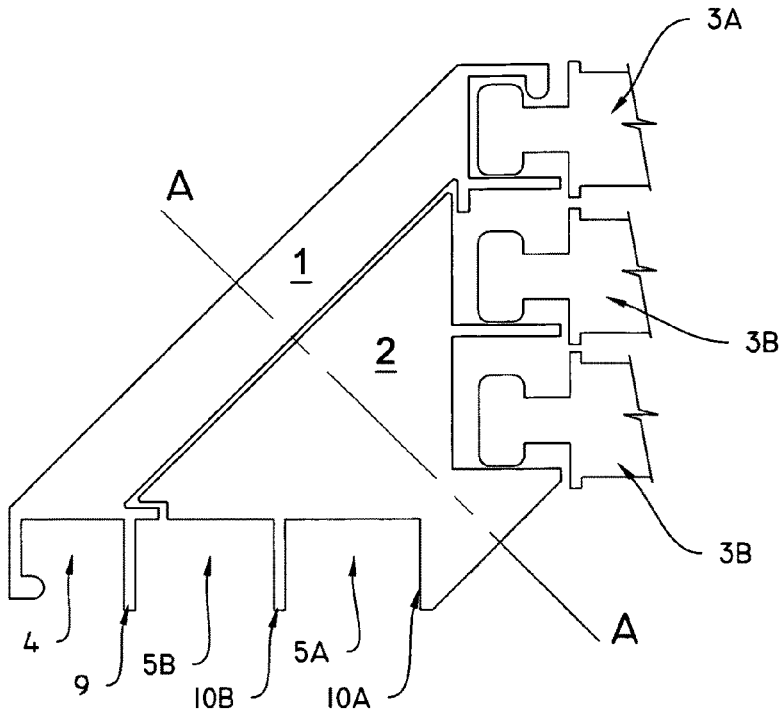
FIG. 14 is a sectional view of a rail post illustrating an inner member having, on either, side two panel guides while the outer member has, on either side, one panel guide.
Figure 15:
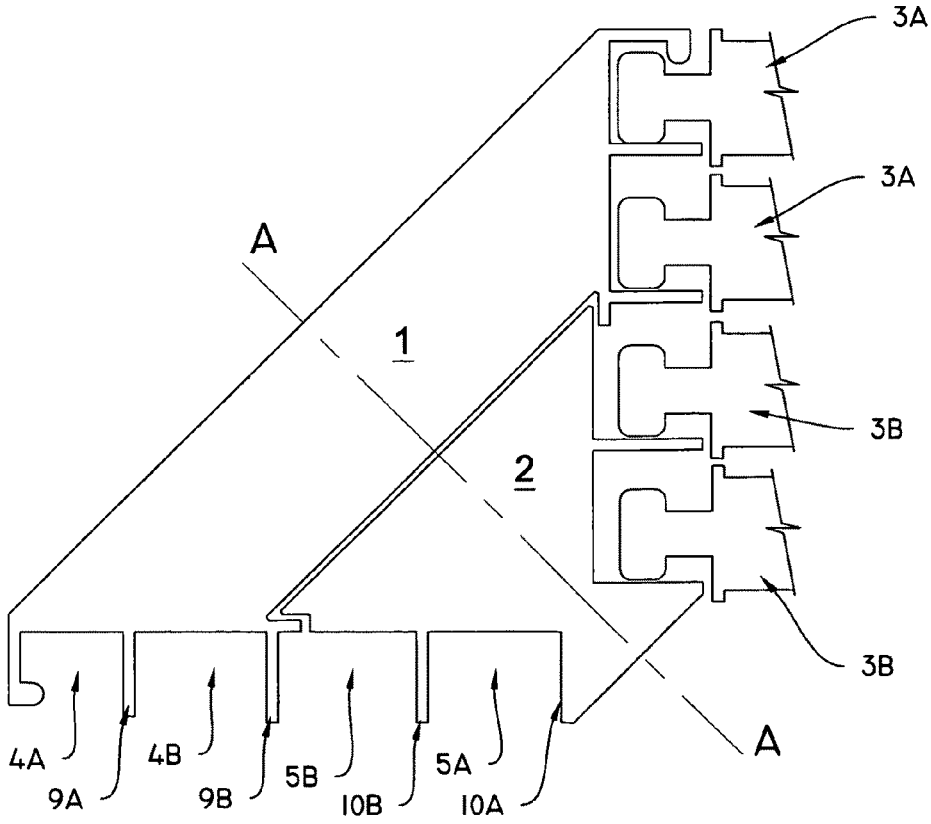
FIG. 15 is a sectional view of a rail post illustrating an outer member and an inner member having, on either side, two panel guides respectively.

FIG. 14 shows an inner member 2 of the rail post having laterally, on either side, more than one panel guide, actually two 5A and 5B, while the outer member 1 has only one panel guide 4. As shown in FIG. 15, the outer member 1 and the inner member 2 have laterally more than one panel guide, indeed two respectively 4A, 4B and 5A, 5B.

Figure 16:
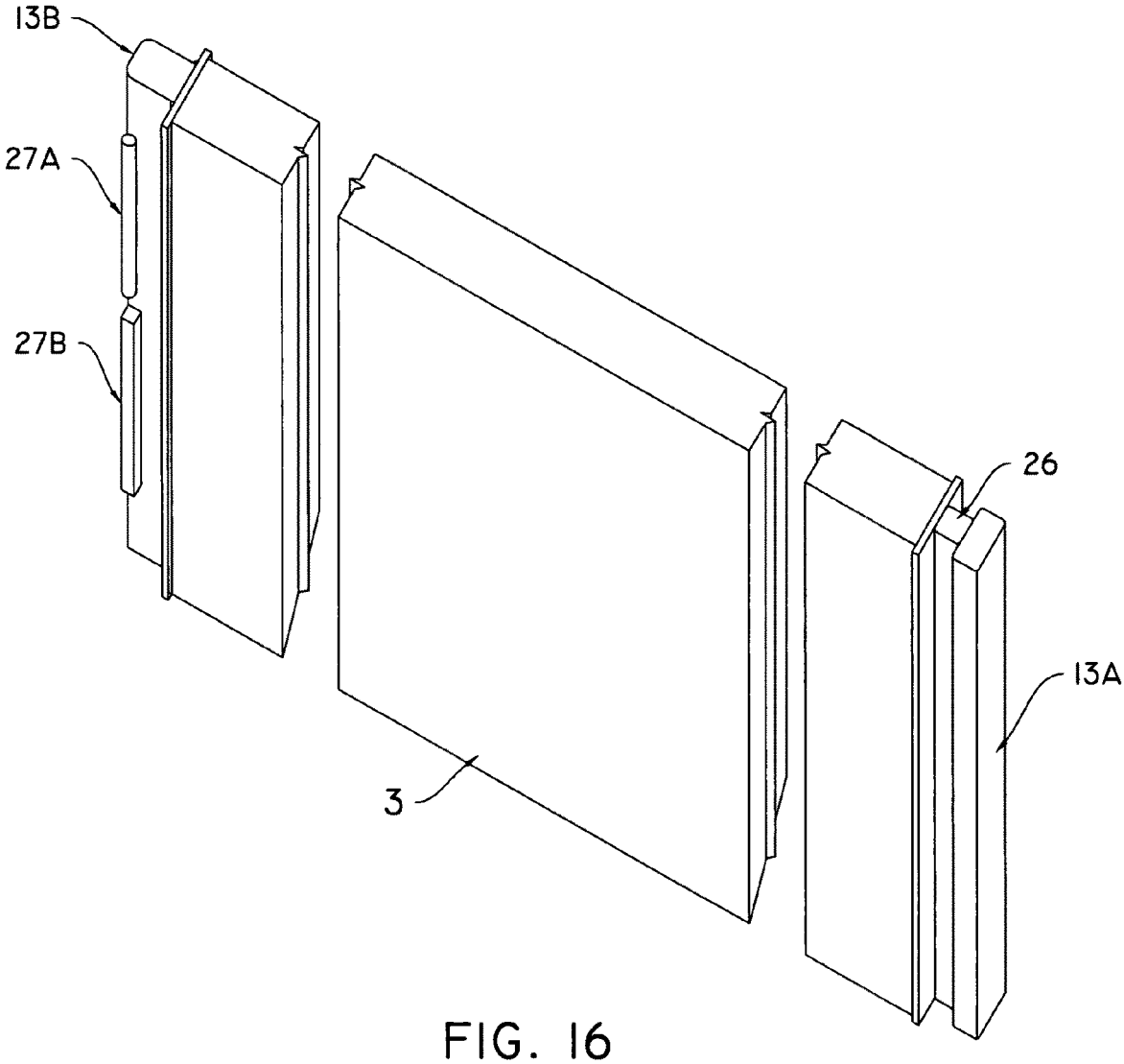
FIG. 16 is a three dimensional view of the shoring panel.

FIG. 16 shows the shoring panel 3 having laterally on either end, an edge guide of type 13A or 13B. According to the type of the edge guide, locking bars 27A or 27B are provided or the spacing body 26 in order to interlock within panel guide 4 of the outer member 1 as shown previously. Additional features of the panel 3 that are not relevant to the invention are not shown.

The method of fabrication of outer member 1 and the inner member 2 of the rail post is not relevant to this invention and may be made by fastening or welding together steel flat bars, standard or specially shaped structural steel or other commonly used material in the industry.

I claim:

1. A shoring system comprising:

a) at least one rail post, said rail post having at least one outer member and one inner member;

said outer member and said inner member having laterally, on either side, at least one panel guide;

said outer member having a front guide and said inner member having a back guide, said front guide and said back guide interlocking cooperatively so that said inner member slides telescopically and projects below said outer member with or no overlap;

b) shoring panels having laterally on either end a guide edge to slide within said panel guide of said outer member to form an outer shoring wall, and said panel guide of said inner member to form an inner shoring wall so that said inner shoring wall slides within said outer shoring wall and projects below thereof forming all together a stepped shoring wall wherein said outer shoring wall is vertically above the inner shoring wall with or without overlap.

2. The shoring system of claim 1 wherein said panel guide of said outer member is adapted to interlock said guide edge of said shoring panel so that said shoring panel slides interlockingly within said panel guide of said outer member.

3. The shoring system of claim 1 wherein said panel guide of said inner member is adapted to interlock the said guide edge of said shoring panel so that said shoring panel slides interlockingly within said panel guide of said inner member.

4. The shoring system of claim 1 wherein said panel guide of said outer member is aligned offset to said panel guide of said inner member.

5. The shoring system of claim 1 wherein said panel guide of said outer member is aligned onset to said panel guide of said inner member.

6. The shoring system of claim 1 further comprising an intermediate member, said intermediate member having laterally, on either side, a panel guide allowing said shoring panel to slide within; said intermediate member being provided with a back guide interlocking said front guide of said outer member, and a front guide interlocking said back guide of said inner member.

7. The shoring system of claim 1 wherein lateral opposing sides of said outer member and of said inner member make an angle $\alpha$, said angle $\alpha$ taking a value between 0 degrees and 180 degrees so that said shoring panels sliding on either side of said outer member and of said inner member make an angle $\beta$ given by the relationship $\alpha=180-\beta$.

8. The shoring system of claim 1 wherein said inner member has laterally, on either side, two said panel guides for sliding said shoring panel.

9. The shoring system of claim 1 wherein said outer member has laterally, on either side, two said panel guides for sliding said shoring panel.

* * * * *